United States Patent [19]

Lee

[11] 4,174,874

[45] Nov. 20, 1979

[54] ELECTRIC PLUG

[76] Inventor: Hop Lee, 2425 24th Ave., San Francisco, Calif. 94116

[21] Appl. No.: 886,669

[22] Filed: Mar. 15, 1978

[51] Int. Cl.[2] ..... H01R 3/06

[52] U.S. Cl. ..... 339/14 P

[58] Field of Search ..... 339/14 P, 14 RP

[56] References Cited

U.S. PATENT DOCUMENTS

| | | | |
|---|---|---|---|
| 2,984,808 | 5/1961 | Bender | 339/14 RP |
| 2,986,718 | 5/1961 | Bender, Jr. | 339/14 RP |
| 3,685,000 | 8/1972 | Robbins | 339/14 P |

*Primary Examiner*—Roy Lake
*Assistant Examiner*—DeWalden W. Jones
*Attorney, Agent, or Firm*—William R. Piper

[57] ABSTRACT

An electric plug that has a retractable ground terminal in addition to the customary two terminals. Novel means is used for electrically connecting the three wires to the three terminals without the need of screws functioning as binding posts between the wires and the terminals.

2 Claims, 12 Drawing Figures

FIG-10-
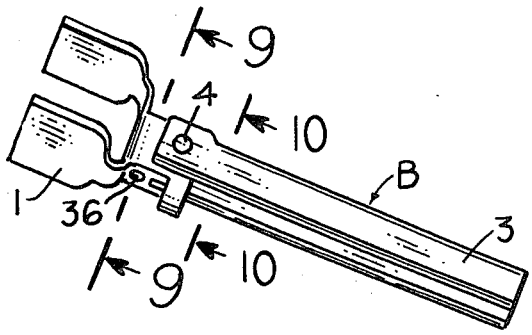
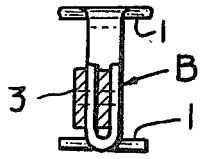
FIG-8-
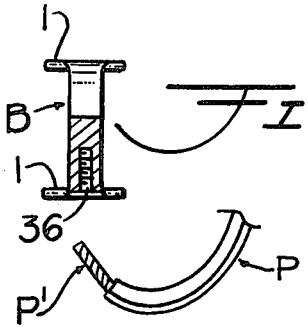
FIG-9-
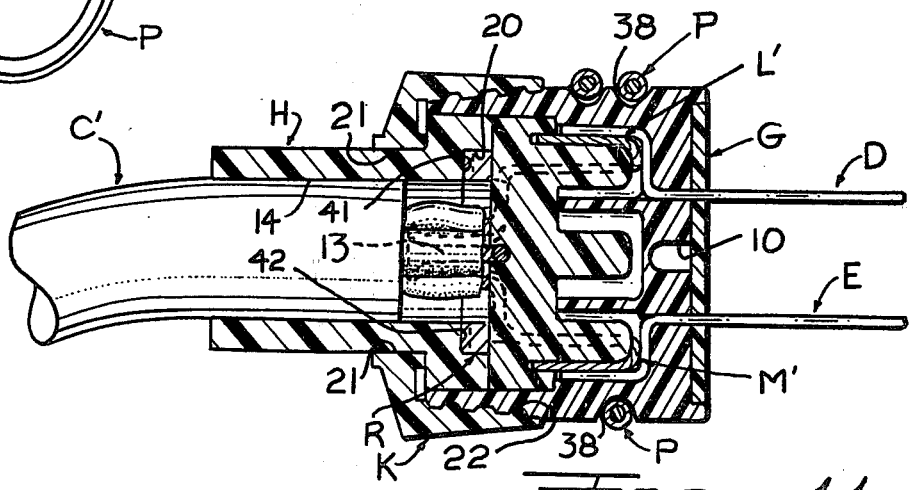
FIG-11-
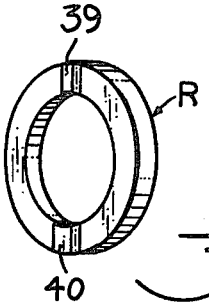
FIG-12-

ELECTRIC PLUG

SUMMARY OF THE INVENTION

This invention is an improvement over the electric plug with retractable ground terminal disclosed in my co-pending application Ser. No. 769,839, filed Feb. 17, 1977, patented Mar. 28, 1978,U.S. Pat. No. 4,081,206. In that application I showed a ground terminal electrically connected to the ground wire in the plug only when the ground terminal cannot be used and is swung into a retracted position and concealed from view.

The novelty in the present electric plug lies in the means for providing an electrical connection between the wires and the electrodes without the need for screws for connecting them together. The various parts of the plug are so designed that the mere assembling of these parts together will at the same time provide a binding electrical connection between the wires and their associate electrodes.

BRIEF DESCRIPTION OF THE DRAWINGS

FIG. 8 is an enlarged perspective view of the pivoted "ground" terminal.

FIG. 9 is an enlarged transverse section taken along the line 9—9 of FIG. 8 and illustrates how the "ground" wire is connected to the "ground" terminal without the need of a set screw.

FIG. 10 is another enlarged transverse section taken along the line 10—10 of FIG. 8 and shows how the "ground" terminal is pivotally connected to a base portion of the terminal.

FIG. 11 is a longitudinal section through the electric plug which is similar to FIG. 3, except that the insert of that Figure is removed so that the sleeve can accommodate a larger size cable.

FIG. 12 is a perspective view of a ring which is used to be received in an annular groove in the sleeve to fill the groove when the insert is not used in the electric plug.

DESCRIPTION OF THE PREFERRED EMBODIMENT

Figure 3:
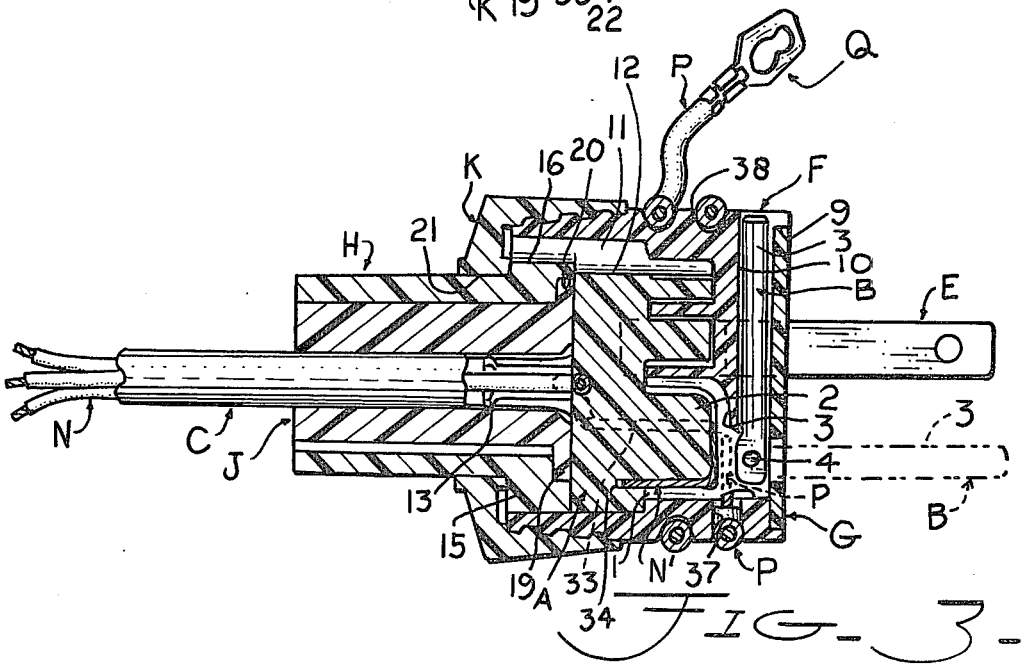
FIG. 3 is a longitudinal section taken along the line 3—3 of FIG. 2, but shows the "ground" terminal in retracted position by full lines, and in operative position by double dot dash lines.
Figure 4:
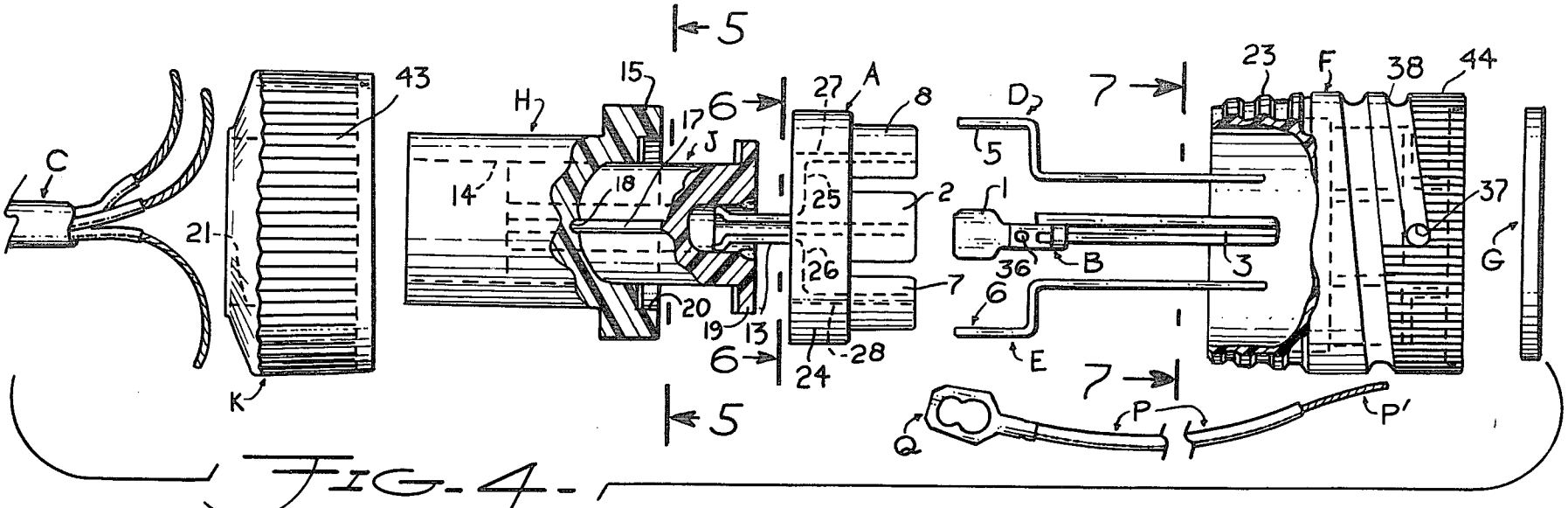
FIG. 4 is an exploded view of the various parts forming my electric plug and certain portions are shown in section.

In carrying out my invention I will first refer to the exploded view of FIG. 4 where the different parts of the electric plug are shown in enlarged detail. A terminal carrier A, is shown in this Figure and also in FIGS. 2 and 3. A pivoted "ground" terminal B, shown in detail in FIGS. 8, 9 and 10, has a U-shaped base 1 that grips a projection 2, see FIG. 3, on the terminal carrier A. I will describe hereinafter how the U-shaped base 1 is held in electrical contact with the "ground" wire of the electrical cable C. The base 1 of the "ground" terminal B, has an electrode 3 pivoted thereto at 4, see FIG. 8, so that this terminal can be swung from inoperative position, shown by the full lines in FIG. 3, into operative position, shown by the double dot dash lines. I will explain later how the "ground" pivoted terminal is secured to the terminal carrier A.

Figure 1:
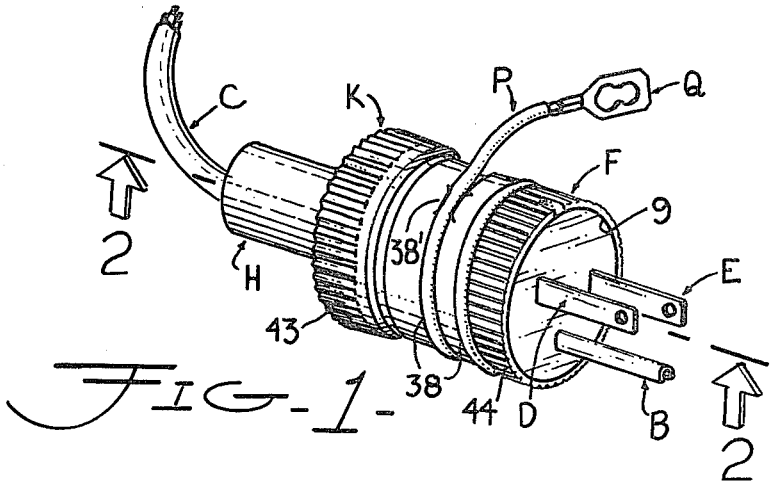
FIG. 1 is a perspective view of the electric plug showing the "ground" terminal in operative position.
Figure 2:
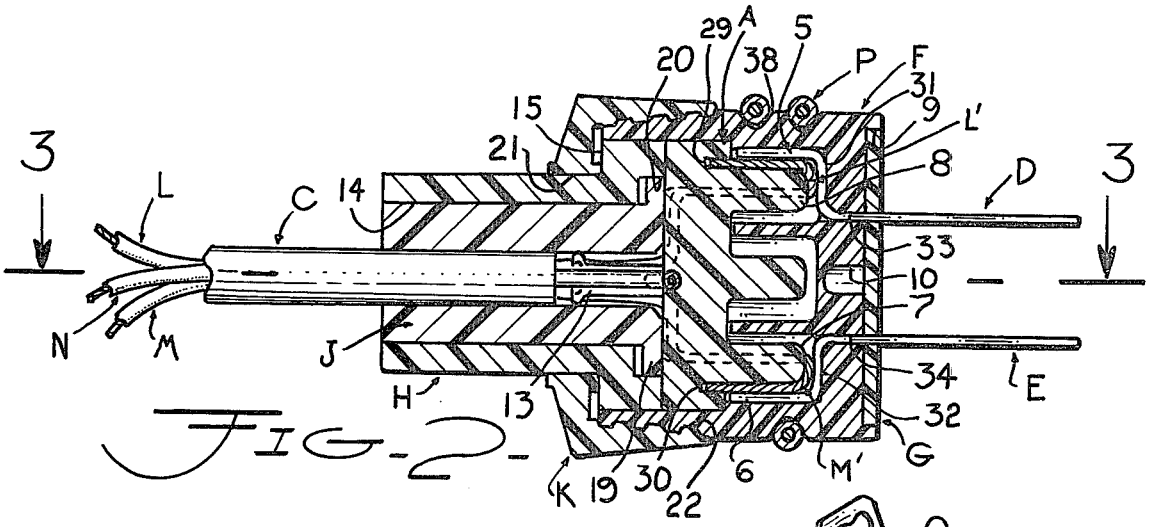
FIG. 2 is an enlarged longitudinal section taken along the line 2—2 of FIG. 1 and looking away from the "ground" terminal so that this terminal is not shown in this Figure.

In FIGS. 2 and 4, I show a pair of electrodes D, and E, and these have an offset portion 5 and 6, respectively, that bare against two other projections 7 and 8 on the terminal carrier A, and form electrical contacts with the two other wires in the cable C. I provide an end cap F, see FIGS. 1 to 4, inclusive and FIG. 7, for receiving the terminal carrier A and for securing the pivoted "ground" terminal B, and the two electrodes D and E, in place. This end cap F has a cylindrical portion and a closed end with a recess 9 therein for removably receiving a cover disc G. FIGS. 1 to 3 inclusive, show three openings in the cover disc for receiving the "ground" terminal B, and the two electrodes D and E. Also, the closed end of the end cap F has three openings through which the terminal and the two electrodes extend. In addition the closed end of the end cap has a diametrically extending groove 10 in its outer surface and projecting from the opening for the pivoted electrode 3 when it is swung into inoperative position.

Figure 6:
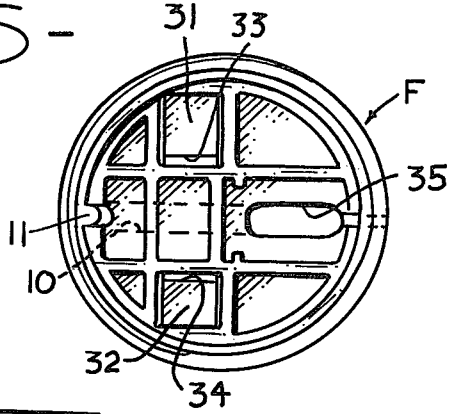
FIG. 6 is a face view of the terminal carrier when looking in the direction of the arrows 6—6 of FIG. 4.

It is necessary that the terminal carrier A, be properly aligned with the end cap F, before the end cap can be slipped over the terminal carrier A, and this is accomplished by a key 11 provided on the inner surface of the cylindrical portion of the end cap F, and receivable in a groove 12 in the terminal carrier, see FIGS. 3 and 6. When the terminal carrier A, is received in the cylindrical portion of the end cap F, it would be difficult to remove and therefore I provide an axially positioned handle 13 that extends beyond the inner end of the end cap F when the terminal carrier is entirely received therein. This permits the handle 13 to be grasped when removing the terminal carrier from or when inserting it into the end cap.

I make use of a thimble, indicated generally at H, in FIGS. 1 to 5 inclusive and FIG. 11. This sleeve has a large diameter bore 14 for receiving a large diameter cable C, as shown in FIG. 11, or if the smaller diameter cable C, is used, then an insert J, with a smaller diameter longitudinal bore is mounted within the sleeve as shown in FIGS. 2 and 3. The sleeve H, is shown in detail in FIGS. 4 and 5, and it has an annular flange 15 at one end that is designed to abut the terminal carrier A. The key 11 in the end cap F, not only extends into the groove 12 in the terminal carrier A, when the terminal carrier is inserted into the end cap, but the same key 11 is also received in a groove 16, provided in the rim of the annular flange 15 of the sleeve H. This will properly align the sleeve H with the terminal carrier A when the two are mounted in the end cap F.

Figure 5:
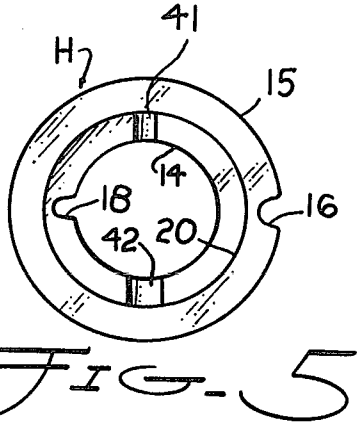
FIG. 5 is an end view of the sleeve when looking in the direction of the arrows 5—5 in FIG. 4.

The insert J, has a length equal to that of the sleeve H, and has an outer diameter equal to the inner diameter of the sleeve bore 14, see FIGS. 2, 3 and 4. The insert J, is provided with a longitudinally extending key 17 on its outer cylindrical surface and this key is slidably received in a longitudinally extending groove 18 formed in the inner cylindrical surface of the sleeve bore H, as shown in FIG. 5. It will be further noted that the insert J has an annular flange 19, see FIGS. 2 and 3 at one end and this flange is received in an annular groove 20 in the sleeve H, see also FIGS. 4 and 5, when the insert is mounted within the sleeve.

A coupling K has a bore 21 for receiving the sleeve H, see FIGS. 2, 3, 4 and 11, and the cylindrical skirt of the coupling is internally threaded at 22 and is adapted to receive the externally threaded portion 23, see FIG. 3, of the end cap F. When the coupling K, is threaded onto the end cap F, it will bear against the annular flange on the sleeve H, and force it and the insert J, against the terminal carrier A, and clamp these parts together.

I will now describe how the three wires in the cable C, are brought into electrical connection with the pivoted "ground" terminal B, and the two electrodes D and E, without the necessity of using fastening screws for this purpose. Two of the wires L and M, see FIG. 2, that are to be connected to the electrodes D and E, respectively, extend beyong the inner end of the cable C, and are received in two of the three longitudinally extending grooves 13*a* and 13*b* in the axial handle 13 for the terminal carrier A, as shown in FIG. 6. A face view of the terminal carrier A, is shown in FIG. 6, and I have shown the disc-shaped base 24 provided with three radially extending grooves. Two of these radial grooves 25 and 26, receive the wires L and M, and the casings for these wires terminate in the grooves while the exposed wire strands M′ and L′, extend beyond the wire casings or coverings and are received in bores 27 and 28 in the base 24 and in the projections 7 and 8 of the terminal carrier A, see FIG. 4. The wire strands L′ and M′ project beyond the bores 27 and 28 and are bent over the outer ends of the projections 7 and 8 and are received in longitudinal grooves in the same projections with the ends of the wire strands being received in recesses 29 and 30 in the base 24, see FIG. 2.

Figure 7:
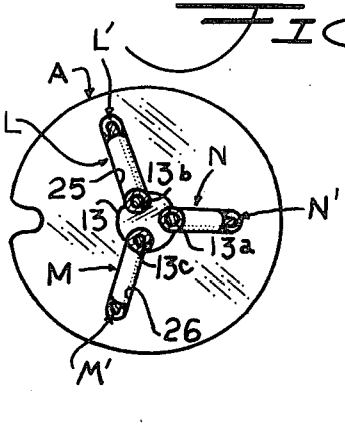
FIG. 7 is an inner end view of the end cap when looking in the direction of the arrows 7—7 of FIG. 4.

When the end cap F, is telescoped over the terminal carrier A, the flat surfaces 31 and 32 in the cap, see FIG. 7, will press down upon the shoulders in the offset portions 5 and 6, see also FIG. 4, and force these shoulders into electrical contact with the bare wire strands L′ and M′, and in this way an electrical connection between the bare wire strands and the electrodes is effected without the need of screws to act as binding posts. The electrodes D and E project through the openings 33 and 34 in the cap F, as shown in FIG. 2.

The "ground" wire N, in the cable C, in FIG. 3, extends beyond the inner end of the cable and is received in the remaining longitudinal groove 13*c*, in the axial handle 13 of the terminal carrier A, see also FIG. 6. Then the wire strands N′ of the "ground" wire N, extend through a bore 33 in the projection 2 of the terminal carrier A, and is bent over the outer end of the projection and is received in the longitudinal groove in the same projection with the end of the wire strand being received in a recess 34 in the terminal carrier A. The wire strands N′ are clamped against the U-shaped base 1 of the pivoted "ground" terminal B, when the end cap F, receives the terminal carrier A, and in this way an electrical connection between the two is effected without the need of a screw functioning as a binding post for the wire strands. When the pivoted electrode 3 of the "ground" terminal B, is in retracted position as shown by the full lines in FIG. 3, the insulated cover G, will enclose it. FIG. 7 shows the end cap F, with an opening 35 through which the pivoted electrode 3, extends when it is swung into operative position as shown by the double dot dash line position of FIG. 3. All of the parts are held in tight position when the knurled coupling K connects the sleeve H to the end cap F.

I provide an independent "ground" wire P, which is used when the pivoted electrode 3 of the "ground" terminal B, is in inoperative or retractive position, see FIGS. 1–4, inclusive and FIG. 11. One end of the independent "ground" wire is illustrated in FIG. 9, and the U-shaped base 1 for the terminal B, has a threaded bore 36 which will receive the bare strands P′ of the wire P, when these strands are rotated into the threaded bore to make an electrical connection therewith. FIG. 3, shows the end of the wire P, received in an opening 37 in the end cap F, and the bare wire strands P′ twisted into the threaded bore 36 to form an electrical connection with the terminal B, without the need of a screw to function as a binding post.

The end cap F has a helical groove 38, see FIGS. 1–4, inclusive and FIG. 11, for receiving the independent "ground" wire P, when the electrode 3 of the "ground" terminal B, is in operative position. The end portion 38′, see FIG. 1, of the helical groove 38, is restricted in size to frictionally grip the wire P, and prevent its accidental unwinding from the groove. A metal contact Q, is connected to the bare strands of the wire P, and when the electrode 3 of the "ground" terminal B, is retracted, the independent "ground" wire P, is unwound from its helical groove 38, and the metal contact Q, is connected to a "ground" screw, not shown, of an electric outlet box, not shown, to which my electric plug is connected. If the electric outlet box has a connection to which the extended electrode 3 of the "ground" terminal B, may be connected, then the independent "ground" wire P, is not used and is wound in the helical groove 38 in the end cap F.

I make provision for my electric plug to accommodate a cable C′ of a larger diameter than the cable C. In FIG. 11, the insert J is not used and the large diameter bore 14 in the sleeve H, receives the larger diameter cable. A ring R, see the perspective view in FIG. 12, is used to fill the annular groove 20 in the sleeve H, when the insert J, is removed. This ring has a small lug 39 and a larger lug 40 on its under surface and receivable in similarly shaped recess 41 and 42 opening into the annular groove 20, see also FIG. 5. In all other respects the form of the electric plug in FIG. 11 is the same as that shown and described in FIGS. 1 to 10, inclusive.

The coupling member K, has its outer periphery knurled as at 43, in FIGS. 1 and 4, and in like manner the end cap F, has its outer periphery knurled at 44. The key 11 in the cap F, is received in the groove 12 in the terminal carrier A, and in the groove 16 in the sleeve H, so that all three parts will be properly aligned with each other when the parts are interconnected.

I claim:

1. In an electric plug:

(a) a terminal carrier for supporting a pivoted "ground" terminal and two electrodes;

(b) a cable receiving sleeve with the "ground" wire and two other wires extending beyond the cable casing and being received in three radially extending grooves in said carrier so that when the sleeve abuts the terminal carrier, the three wires will be gripped in the radial grooves;

(c) said terminal carrier having three projections with a bore extending through each one, each bore communicating with one of the radial grooves and receiving the bare wire strands of the wire in that groove, the wire strands of each wire extending over the outer end of its particular projection with the ends of the strands being received in recesses in the terminal carrier, said "ground" terminal and said two electrodes having portions in electrical contact with their associate bare wire strands that extend over the outer ends of the projections;

(d) an end cap for receiving said terminal carrier and having openings through which the "ground" terminal and two electrodes can extend; and (e) a coupling connector for receiving said sleeve and being connectible to said end cap for enclosing said terminal carrier and holding said "ground" terminal and two electrodes in electrical connection with their respective bare wire strands.

2. The combination as set forth in claim 1: and in which (a) said terminal carrier has an axial handle projecting beyond the adjacent end of said terminal carrier and having three longitudinally extending grooves for receiving the three cable wires.

* * * * *